United States Patent [19]

Boiron et al.

[11] Patent Number: 4,537,512

[45] Date of Patent: Aug. 27, 1985

[54] METHOD AND APPARATUS FOR KORSAKOVIAN DILUTION

[75] Inventors: Jean Boiron; Christian Boiron; Jacky Abécassis; André-Marcel Favier, all of Rhone, France

[73] Assignee: Laboratoires Boiron, Rhone, France

[21] Appl. No.: 532,174

[22] Filed: Sep. 14, 1983

[30] Foreign Application Priority Data

Nov. 18, 1982 [FR] France ..... 82 19618

[51] Int. Cl.[3] ..... B01F 11/00

[52] U.S. Cl. ..... 366/132; 366/134; 366/142; 366/160; 366/173; 366/191; 366/212

[58] Field of Search ..... 366/131, 132, 134, 135, 366/138, 151, 152, 153, 160, 161, 167, 173, 179, 180, 181, 191, 212, 213, 214, 237, 348; 422/68, 100; 604/903

[56] References Cited

U.S. PATENT DOCUMENTS

| | | | |
|---|---|---|---|
| 3,794,301 | 2/1974 | Simmonds, Jr. | 366/132 |
| 3,877,682 | 4/1975 | Moss | 366/132 |
| 4,148,610 | 4/1979 | Miller, Jr. et al. | 422/100 |
| 4,277,440 | 7/1981 | Jessop et al. | 422/100 |
| 4,490,047 | 12/1984 | Stegemoeller et al. | 366/132 |

*Primary Examiner*—Robert W. Jenkins
*Assistant Examiner*—Arthur D. Dahlberg
*Attorney, Agent, or Firm*—Remy J. VanOphem

[57] ABSTRACT

An apparatus and method for carrying out the Korsakovian dilution of a master tincture contained in a bottle. The bottle is drained through a vacuum pump acting by way of a control water trap. Then the feed station sends a dose of distilled water into the bottle while the agitator processes the mixture. With each new cycle a programmed display is provided.

15 Claims, 7 Drawing Figures

METHOD AND APPARATUS FOR KORSAKOVIAN DILUTION

BACKGROUND OF THE INVENTION

The present invention relates to a method and an apparatus making it possible to carry out automatically and in an industrial sequence dilutions of the type done particularly for producing homeopathic medicines.

The method and apparatus relates more particularly but not exclusively to the operation known under the name of "Korsakovian dilution".

The manufacture of a homeopathic medicine by this process requires impregnating the inner wall of a bottle with a master tincture, filling the bottle with a premeasured amount of distilled water, then agitating the water by repeated standard shakings, and emptying the bottle. Since traces of the solution to be diluted still adhere to the inner wall of the bottle, it is filled anew with a new premeasured amount of distilled water, and subjected to a new agitation operation, and so on.

Traditionally, the dilution operations were performed manually. Besides the fact that this involves a considerable expenditure of manual work, there is a danger of error in counting the successive dilution cycles, especially if there are many cycles.

The primary object of the present invention is to avoid these disadvantages by providing a method and an apparatus capable of carrying out the successive Korsakovian dilution operations of the type of those observed in the production of homeopathic medicines, in an automatic sequence and without any risk of error.

SUMMARY OF THE PRESENT INVENTION

The present invention provides a method and an apparatus for a Korsakovian dilution intended to process at least one bottle for refilling it, agitating its contents and emptying the latter before starting another similar cycle. The apparatus of the present invention is characterized in that it includes two distinct subassemblies.

The first subassembly is a mechanical apparatus where the bottle is mounted on the shaking clamp of an agitator. The bottle is connected by a first pipe to a feed station filled with distilled water. The bottle is connected by a second pipe with a draining station.

The second subassembly is a control apparatus including the electronic components which automatically insure control of the dosing, the starting of each operation and the display of the number of dilutions made. A first counter serves to display the number of dilutions desired. A second counter indicates at any moment the number of dilutions made.

According to another feature of the present invention, the mechanical unit has two similar stations where two identical operations take place completely independently.

According to still another feature of the present invention, the dosing is insured by piston syringes, each of which has a selectively adjustable filling stroke.

According to yet another feature of the present invention, a three-way cock is provided at each dosing station for the intake and delivery of the liquid.

BRIEF DESCRIPTION OF THE DRAWINGS

The attached drawings illustrate an example of an apparatus according to the present invention and are provided as a nonlimiting example to facilitate understanding of the many objects, features, and advantages of the present invention.

DETAILED DESCRIPTION OF THE PREFERRED EMBODIMENT

Figure 1:
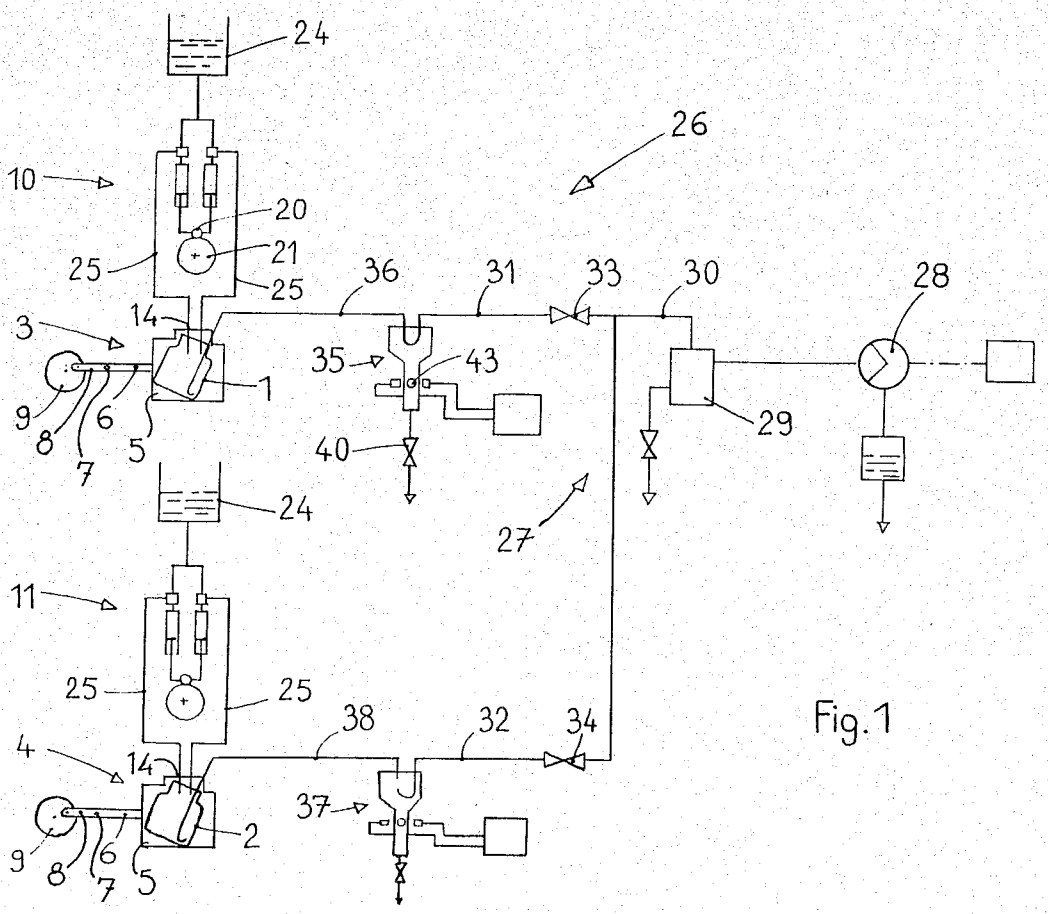
FIG. 1 is an overall view diagrammatically illustrating the principle of operation of a dilution apparatus according to the present invention with two operating stations.

Referring now to the drawing, and more particularly to FIG. 1, a mechanical apparatus 26 according to the invention is provided for processing two bottles 1 and 2 independently but with the same cycle. Each of these bottles contains a solution of a medicinal master tincture which is proposed to reduce in concentration by the Korsakov method until homeopathic dilutions are obtained.

Figure 2:
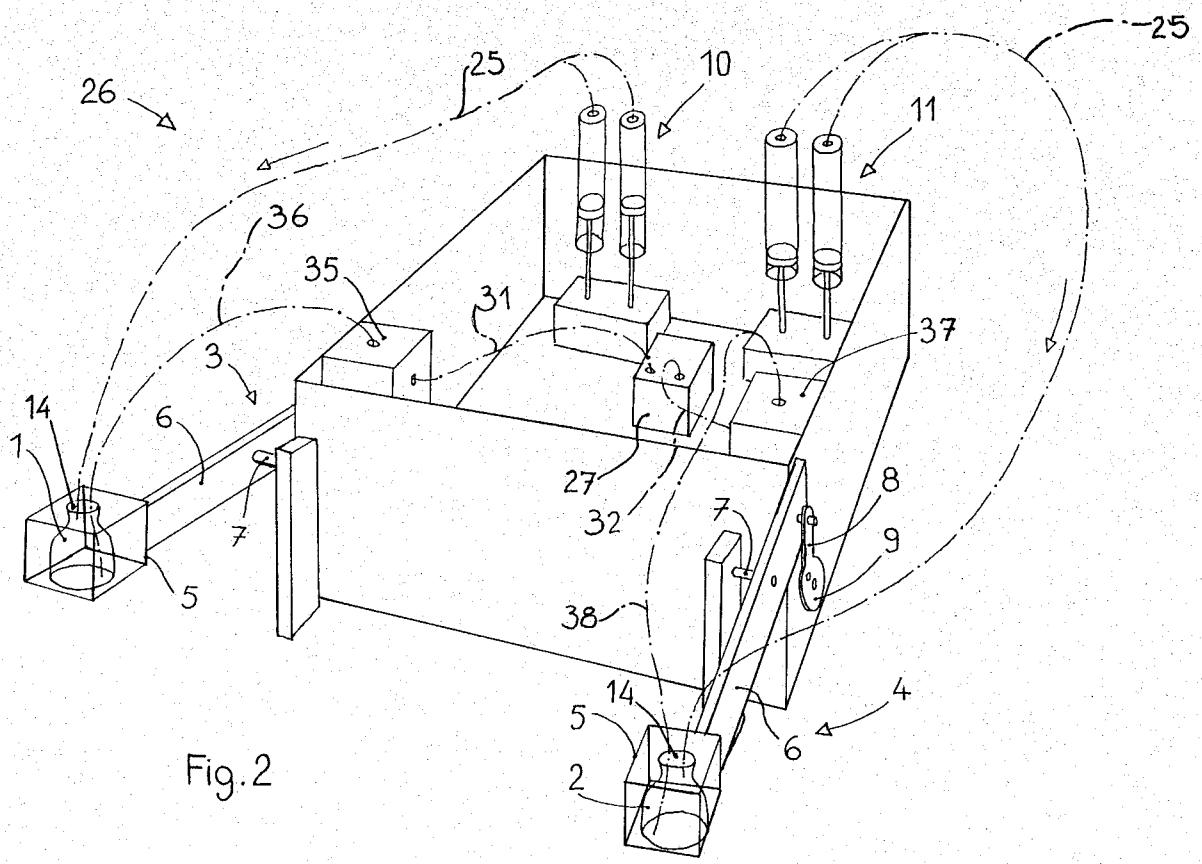
FIG. 2 shows the corresponding mechanical unit where two bottles are processed at the same time.

As best shown in FIG. 2, the mechanical apparatus 26 includes two agitators 3 and 4, each of which has a clamp 5. Each clamp 5 is placed at the end of an arm 6 which can swing around a fixed pin 7. The end of the arm 6 beyond the fixed pin 7 is pivotally mounted to one end of a rod 8 driven by an eccentric 9. A motor, not represented, drives the rotation of the eccentric 9 during the agitation cycle. Thus, each clamp 5 is subjected to a shaking motion transmitted to the bottle 1 or 2 which it contains.

Figure 4:
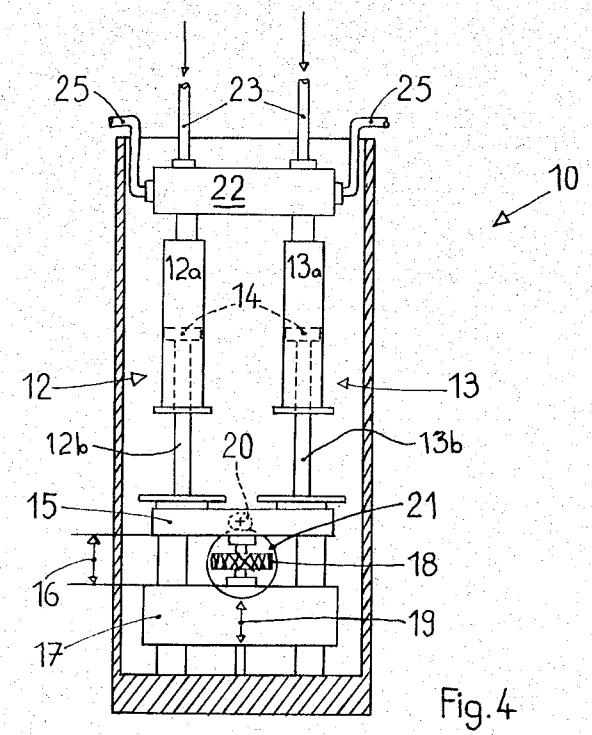
FIG. 4 is a cutaway view and illustrates the principle of operation of each dosing station according to the present invention.

The mechanical apparatus 26 illustrated in FIGS. 1 and 2 moreover includes two feed stations 10 and 11. These two stations are identical to one another. The station 10 has been illustrated in more detail in FIG. 4.

The station 10 includes two vertical syringes 12 and 13, the fixed cylinders **12*a* and 13*a*, respectively, of which are placed side by side. The pistons 12*b* and 13*b*, respectively, of each syringe 12 and 13 are interconnected with a base plate 15. The base plate 15 is a distance 16 from a drive carriage 17 which is fixed, but adjustable by means of a knurled nut 18. The carriage 17 causes the emptying of the cylinders 12*a* and 13*a* by an alternating vertical movement in the direction of the arrow 19. For this purpose, the face of the base plate 15 opposite the pistons 12*b* and 13*b* has a roller 20. An eccentric 21 driven by a motor, not illustrated, rotates thereunder and engages the roller 20. The useful stroke of the pistons 12*b* and 13*b*, respectively, for the two syringes 12 and 13 can be adjusted, as desired, by rotation of the knurled nut 18 to adjust the distance 16**.

The cylinders **12*a* and 13*a* are surmounted by a valve box 22, the intakes 23 of which are connected to a distilled water reservoir 24, shown only in FIG. 1, surmounting the assembly. The delivery openings of the valve box 22 are each connected by a flexible line 25** to the detachable bottle fitting of the corresponding bottle 1 or 2 into which it empties. The detachable bottle fitting is not illustrated in the drawing but is provided generally at 14, as shown in FIGS. 1 and 2.

Thus, the syringes 12 and 13 draw in an amount of distilled water which can be proportioned with the aid of the knurled nut 18, and then they deliver it into the bottles 1 and 2, respectively.

The eccentrics 21 are driven at the two feed stations 10 and 11. Thus, the syringe 12 of the feed station draws in a proportioned amount of distilled water, independently of the movement of the syringe 13 of the feed station 11.

The mechanical apparatus 26 also has an intake and drainage station 27, as shown in FIGS. 1 and 2. The intake and drainage station 27, as shown in FIG. 1, consists of a vacuum pump 28 which, by way of a condenser 29, provides continuous suction in a line 30. The line 30 is divided by forking into two lines 31 and 32, each provided with an opening or closing electromagnetic valve 33 and 34, respectively. The line 31 is connected, by way of a control cell 35 or water trap, to a line 36 which goes through the detachable bottle fitting provided generally at 14, of the bottle 1 to go into the bottle 1.

Similarly, the line 32 is connected by a control cell 37 or water trap to an intake line 38 into the interior of the bottle 2.

Each of the intake lines 36 and 38 goes into the bottom of the corresponding bottle 1 or 2, in such a manner as to be able to empty the bottles as completely as possible.

Figure 3:
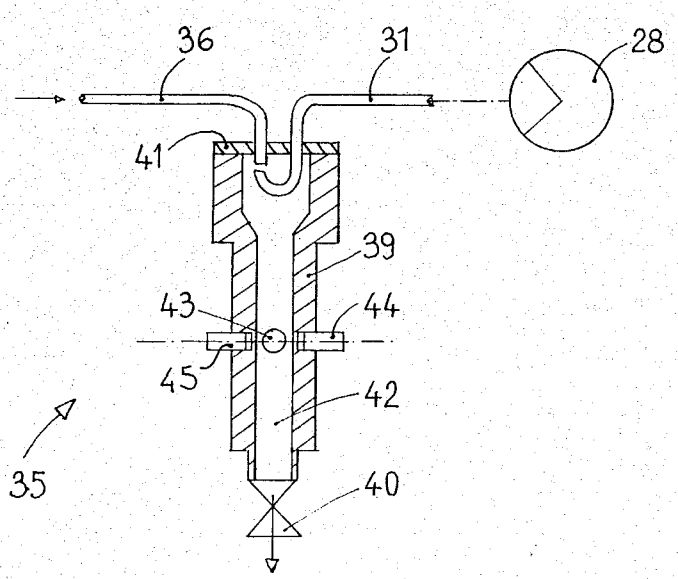
FIG. 3 shows details of the "water trap" according to the present invention provided for verifying that the corresponding bottle is emptied.

The control cells 35 and 37 are identical, and only one of these, the cell 35, has been illustrated in detail in FIG. 3. The cell 35 consists of a reservoir 39 provided at its base with an opening or closing electromagnetic draining valve 40. The tight lid 41 of the reservoir 39 is crossed by the corresponding ends of the lines 31 and 36. The line 31 maintains a reduced pressure inside the reservoir 39. This reduced pressure has the effect of intake of the liquid 42 coming from the bottle 1. As long as the electromagnetic draining valve 40 remains closed, the liquid 42 accumulates in the reservoir 39, and a little ball 43 floats on its surface. A radiation transmitting cell 44 and a receiving cell 45 are built in face to face in the wall of the reservoir 39. If the level of the liquid 42 puts the floating ball 43 between the transmitting cell 44 and the receiving cell 45, the radiation transmitted by the radiation transmitting cell 44 becomes interrupted. The receiving cell 45 then detects the presence of the ball 43 and actuates the opening of the electromagnetic draining valve 40. When the ball 43 drops to the bottom of the reservoir 39, it is certain that the bottle 1 has been completely emptied, and the receiving cell 45 simultaneously actuates the closing of the two electromagnetic valves 33 and 40.

The control cell 37 operates in the same manner as the control cell 35.

By this arrangement, a single vacuum pump 28 is used to selectively empty one or another of the two bottles 1 and 2.

Figure 5:
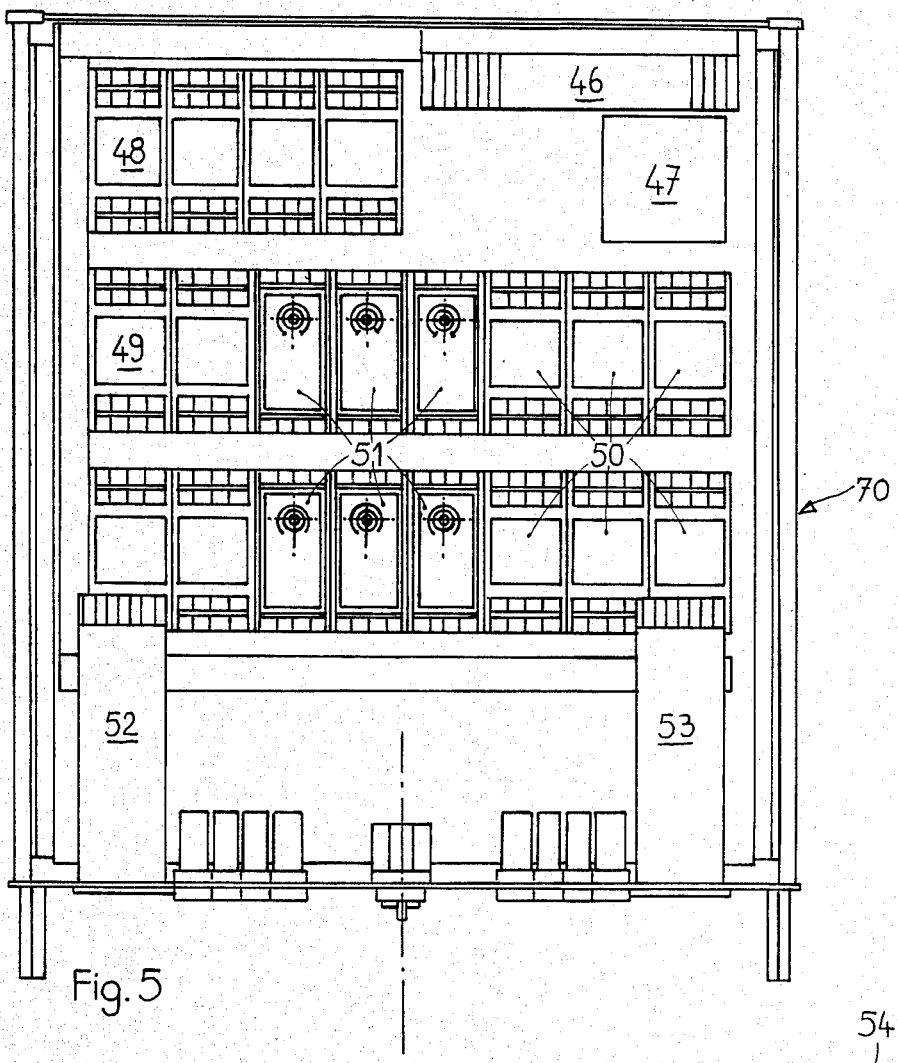
FIG. 5 is a front elevational view showing the whole of the control box of the control unit.
Figure 6:
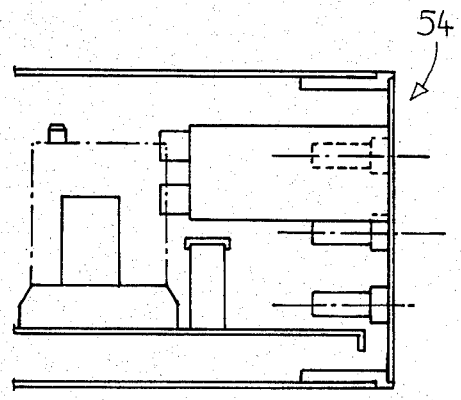
FIG. 6 is a side elevational view of portions of the control box of FIG. 5.
Figure 7:
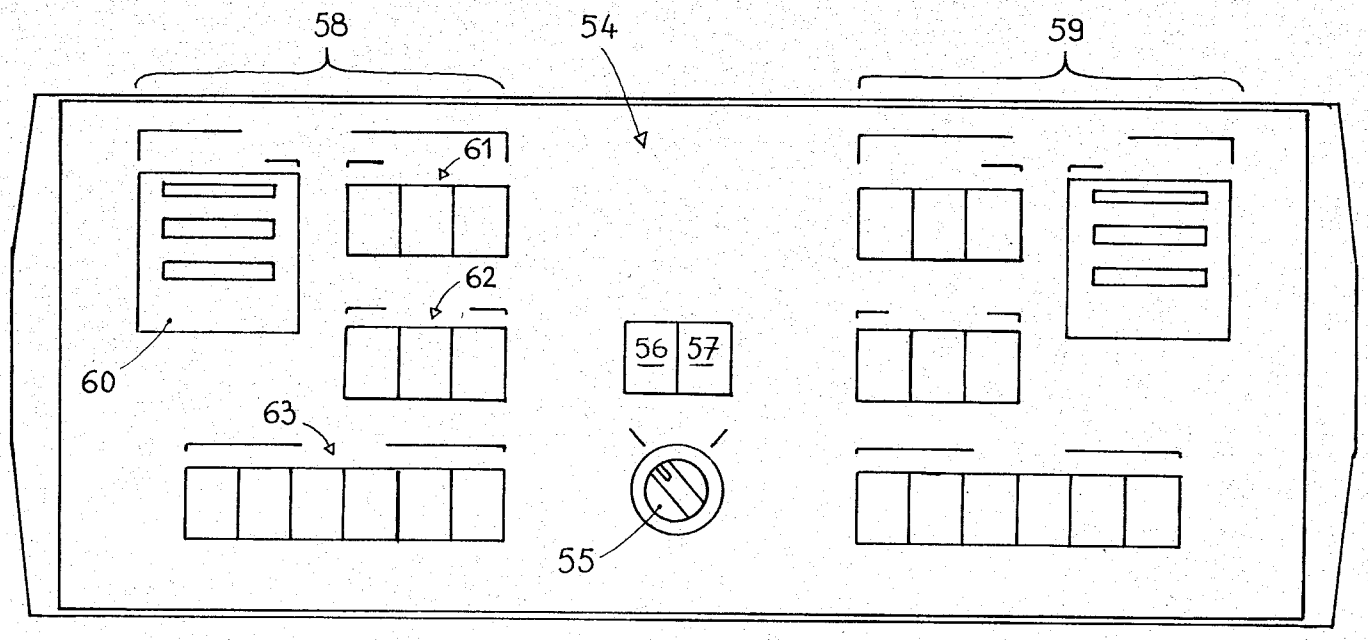
FIG. 7 is a front view of a possible embodiment of a control console through which an operator operates and controls the apparatus of the present invention.

The control apparatus 70 according to the present invention is illustrated in FIGS. 5 to 7. The control apparatus 70 insures the operation in sequence of the programs on the two stations of the mechanical apparatus 26.

The control apparatus 70, as shown in FIG. 5, includes a terminal unit 46, a supply transformer 47, memory relays 48, 49 and 50, timelag relays 51, and two counters 52 and 53 each relating to one of the feed stations 10 and 11, respectively, for counting their cycles.

The control apparatus 70 is further provided with a control console 54, best shown in FIG. 7. The control console 54 includes a general start-stop switch 55, a pilot lamp 56 for starting authorization, a pilot lamp 57 signaling the existence of voltage, and two control units 58 and 59 corresponding to each of the two feed stations, 10 and 11, respectively.

Each of the control units 58 and 59 includes digital indicators 60 which display, at each moment, the number of dilutions carried out and the desired number of dilutions and indicators 61 for monitoring the volume, as well as signals to indicate whether the dosing is good or if it is defective, or if some other defect appears. Each of the control units 58 and 59 further includes a display 62 for the automatic operation, that is, automatic start-stop, and a display 63 for manual control, that is, one grouping the buttons and indicators which makes it possible to actuate, one by one, the successive operations of starting, dosing, agitating, intake, draining, etc.

The operation of the present invention is as follows:

The operator initiates the operation of the apparatus by means of the start-stop switch 55. With the aid of the displays 62 and 63, the operator chooses an automatic operating sequence, or one with manual control, for the dilution operations.

When the bottle 1 is full of the diluted master tincture, the electromagnetic valve 33 is opened, which causes the intake of the liquid. Once the bottle 1 is emptied, the floating ball 43 causes the draining electromagnetic valve 40 to open, while the valve 33 is closed. Thus the vacuum is broken.

The syringes of the feed station 10 then send to the bottle 1 a proportioned quantity of distilled water, which makes the dilution, while the agitator 3 agitates the bottle 1. At the end of this operation the valve 33 is opened anew, which empties the bottle into the water trap 35. Once the emptying operation is complete, the electromagnetic draining valve 40 is opened anew. The above operations are, therefore, repeated for a preselected number of cycles.

The number of dilution cycles is automatically displayed on the control console 54.

As stated previously, the operating cycles are staggered on the two feed stations 10 and 11, which makes it possible to use only a single vacuum pump 28 connected alternately to the bottle 1, then to the bottle 2.

It will be appreciated by those skilled in the art that many modifications and variations are possible to the method and apparatus described above within the scope of the present invention. Such modifications and variations are within the intended scope of the claims appended hereto.

What is claimed as novel is as follows:

1. A Korsakovian dilution apparatus for processing at least one bottle by impregnating the inner wall of said at least one bottle with a tincture and repeatedly filling said at least one bottle with a predetermined amount of fluid, agitating said at least one bottle to dissolve a portion of said tincture into said fluid to produce a solution, and emptying said solution from said bottle for a predetermined number of cycles, said Korsakovian dilution apparatus comprising:

bottle clamping means for securing said at least one bottle;

fluid supply means for selectively supplying said at least one bottle with said predetermined amount of fluid;

shaking means selectively imparting a shaking motion to said bottle clamping means such that a portion of said tincture dissolves in said fluid to produce said solution;

solution intake means selectively operable to draw said solution from said at least one bottle;

automatic control means sequentially controlling said fluid supply means, said shaking means, and said intake means to repeatedly produce said solution from said predetermined amount of said fluid; and automatic counting means counting the number of cycles of operation controlled by said automatic control means.

2. The Korsakovian dilution apparatus of claim 1 wherein said fluid is distilled water.

3. The Korsakovian dilution apparatus of claim 1 wherein said fluid supply means comprises at least one syringe having a cylinder, a piston, and stroke adjusting means such that the stroke of said syringe is adjustable to provide said predetermined amount of fluid.

4. The Korsakovian dilution apparatus of claim 1 wherein said fluid supply means further comprises:

at least one syringe having a cylinder, and a piston movably inserted into said cylinder, said cylinder and said piston each having a free end;

frame means interconnected with one of said free ends;

plate means interconnected with the other of said free ends opposite said one of said free ends; and rotary eccentric means interposed said plate means and said frame means, said rotary eccentric means reciprocating said plate means relative to said frame means and, thereby, reciprocating said piston relative to said cylinder to inject a preselected quantity of fluid into said at least one bottle.

5. The Korsakovian dilution apparatus of claim 4 further comprising adjustment means interposed said other free end and said plate means such as to permit adjustment of said preselected quantity of fluid to said predetermined amount of fluid.

6. The Korsakovian dilution apparatus of claim 1 wherein said fluid supply means further comprises two syringes selectively operable simultaneously to inject said predetermined amount of fluid into said at least one bottle.

7. The Korsakovian dilution apparatus of claim 1 wherein said shaking means comprises an arm interconnected with said bottle clamping means and eccentric drive means pivotally driving said arm to oscillate said bottle clamping means.

8. The Korsakovian dilution apparatus of claim 1 wherein said solution intake means further comprises:

water trap means having a reservoir;

a first line extending from said at least one bottle to said reservoir;

vacuum pump means having a vacuum port and being selectively operable to create a vacuum pressure at said vacuum port; and a second line extending from said vacuum port to said reservoir to create a vacuum therein such that said vacuum in said reservoir draws said fluid from said at least one bottle into said reservoir.

9. The Korsakovian dilution apparatus of claim 8 wherein said water trap means further comprises first selectively operable valve means at the lower end of said reservoir selectively operable to permit drainage of said solution from said reservoir.

10. The Korsakovian dilution apparatus of claim 9 wherein said water trap means further comprises solution level detection means responsive to the level of solution in said reservoir such that when said level of solution reaches a predetermined level indicative of the draining of a predetermined amount of solution from said at least one bottle, said solution level detection means opens said first selectively operable valve means.

11. The Korsakovian dilution apparatus of claim 9 wherein said solution level detection means further comprises:

radiation transmitting means disposed adjacent said reservoir;

radiation receiving means disposed adjacent said reservoir and on the opposite side thereof from said radiation transmitting means such that said radiation receiving means detects radiation from said radiation transmitting means which has traversed said reservoir at said predetermined level; and radiation blocking means in said reservoir, said radiation blocking means being comprised of a material having a specific gravity less than said solution such that said radiation blocking means floats in said solution, said radiation blocking means thereby blocking said radiation receiving means from receiving radiation from said radiation transmitting means when said solution reaches said predetermined level.

12. The Korsakovian dilution apparatus of claim 9 further comprising valve closing means selectively operable to close said first selectively operable valve means after said reservoir has been drained of said solution.

13. The Korsakovian dilution apparatus of claim 8 wherein said vacuum pump means comprises:

a vacuum pump; and a second selectively operable valve means interposed said vacuum pump and said second line such as to selectively create a vacuum in said reservoir.

14. The Korsakovian dilution apparatus of claim 1 wherein two of said bottles are used, each being impregnated with tincture, said Korsakovian dilution apparatus further comprising:

two of said bottle clamping means for independently securing said bottles;

two of said fluid supply means for independently supplying said bottles with said fluid;

two of said shaking means for shaking said bottle clamping means; and two of said solution intake means for selectively draining solution from said two bottles, said automatic control means sequentially controlling each of said fluid supply means, shaking means, and intake means to repeatedly produce said solution from fluid and said tincture, said automatic control means alternatingly supplying fluid to said bottles such that said two bottles supply said solution in an alternating manner.

15. The Korsakovian dilution apparatus of claim 14 wherein said two solution intake means comprise:

two water trap means each having a reservoir;

two first lines each interconnecting one of said reservoirs with one of said bottles;

a vacuum pump means having a vacuum port and being selectively operable to create a vacuum pressure at said vacuum port;

two second lines each interconnecting said vacuum port with one of said reservoirs; and two second selectively operable valve means each interposed said vacuum port and one of said second lines.

* * * * *

UNITED STATES PATENT AND TRADEMARK OFFICE

CERTIFICATE OF CORRECTION

PATENT NO. : 4,537,512

DATED : August 27, 1985

INVENTOR(S) : Jean Boiron, et al.

It is certified that error appears in the above-identified patent and that said Letters Patent is hereby corrected as shown below:

Column 4, line 33, delete "draining".

Column 4, line 34, after "netic" insert ---- draining ----.

Signed and Sealed this

*Twenty-seventh* Day of *May 1986*

[SEAL]

*Attest:*

DONALD J. QUIGG

*Attesting Officer*

*Commissioner of Patents and Trademarks*